US010071585B2

(12) United States Patent
Swei et al.

(10) Patent No.: US 10,071,585 B2
(45) Date of Patent: Sep. 11, 2018

(54) PRINT MEDIUM

(71) Applicant: Hewlett-Packard Development Company, L.P., Fort Collins, CO (US)

(72) Inventors: Jason Swei, San Diego, CA (US); Rajasekar Vaidyanathan, San Diego, CA (US); Bor-Jiunn Niu, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 18 days.

(21) Appl. No.: 15/303,115

(22) PCT Filed: May 20, 2014

(86) PCT No.: PCT/US2014/038715

§ 371 (c)(1),
(2) Date: Oct. 10, 2016

(87) PCT Pub. No.: WO2015/178891

PCT Pub. Date: Nov. 26, 2015

(65) Prior Publication Data

US 2017/0036473 A1 Feb. 9, 2017

(51) Int. Cl.
*B41M 5/00* (2006.01)
*B41M 5/52* (2006.01)
(Continued)

(52) U.S. Cl.
CPC ..... *B41M 5/5272* (2013.01); *B41J 2/0057* (2013.01); *B41J 2/01* (2013.01); *B41M 5/50* (2013.01); *B41M 5/508* (2013.01); *B41M 5/52* (2013.01); *B41M 5/5218* (2013.01); *B41M 5/5227* (2013.01); *B41M 5/5236* (2013.01);
(Continued)

(58) Field of Classification Search
CPC .... B41M 5/50; B41M 5/5227; B41M 5/5236; B41M 5/5254; B41M 7/00
See application file for complete search history.

(56) References Cited

U.S. PATENT DOCUMENTS 6,140,406 A 10/2000 Schliesman et al.
8,012,551 B2 9/2011 Song et al.
(Continued)

FOREIGN PATENT DOCUMENTS

EP 1184191 3/2002
WO 2013155062 10/2013
WO 2013165882 11/2013

OTHER PUBLICATIONS

International Search Report dated Feb. 12, 2015 for PCT/US2014/038715, Applicant Hewlett-Packard Development Company, L.P.

*Primary Examiner* — Betelhem Shewareged
(74) *Attorney, Agent, or Firm* — Thorpe North & Western LLP

(57) ABSTRACT

The present disclosure provides a print medium, a printed article, and a method of printing. The print medium can include a thin paper substrate having weight ranging from 40 GSM to 150 GSM, and a pre-treatment coating applied to the thin paper substrate at a weight ranging from 0.3 GSM to 15 GSM. The pre-treatment coating can include from 10 wt % to 80 wt % of a fixer, from 3 wt % to 50 wt % of a latex polymer, and from 5 wt % to 50 wt % of a water holding agent.

19 Claims, 2 Drawing Sheets

(51) Int. Cl.

| | |
|---|---|
| ***B41M 7/00*** | (2006.01) |
| ***B41M 5/50*** | (2006.01) |
| ***D21H 19/10*** | (2006.01) |
| ***D21H 19/18*** | (2006.01) |
| ***D21H 19/54*** | (2006.01) |
| ***D21H 19/80*** | (2006.01) |
| ***D21H 17/66*** | (2006.01) |
| ***D21H 17/00*** | (2006.01) |
| ***D21H 19/22*** | (2006.01) |
| ***D21H 19/34*** | (2006.01) |
| ***D21H 19/60*** | (2006.01) |
| ***D21H 19/64*** | (2006.01) |
| ***D21H 19/72*** | (2006.01) |
| ***B41J 2/005*** | (2006.01) |
| ***B41J 2/01*** | (2006.01) |

(52) U.S. Cl.

CPC ..... *B41M 5/5254* (2013.01); *B41M 7/00* (2013.01); *D21H 17/66* (2013.01); *D21H 17/74* (2013.01); *D21H 19/10* (2013.01); *D21H 19/18* (2013.01); *D21H 19/22* (2013.01); *D21H 19/34* (2013.01); *D21H 19/54* (2013.01); *D21H 19/60* (2013.01); *D21H 19/64* (2013.01); *D21H 19/72* (2013.01); *D21H 19/80* (2013.01); *B41J 2002/012* (2013.01)

(56) References Cited

U.S. PATENT DOCUMENTS

| | | | | |
|---|---|---|---|---|
| 8,314,171 | B2 | 11/2012 | Park | |
| 8,425,993 | B2 | 4/2013 | Knight et al. | |
| 2007/0207278 | A1 | 9/2007 | Mukherjee et al. | |
| 2007/0237910 | A1 | 10/2007 | Zhou et al. | |
| 2009/0311426 | A1* | 12/2009 | Nakazawa ..... | B41J 2/2114 427/256 |
| 2010/0143835 | A1 | 6/2010 | Shin et al. | |
| 2010/0159164 | A1 | 6/2010 | Zhang et al. | |
| 2010/0233391 | A1 | 9/2010 | Kumada et al. | |
| 2011/0303113 | A1 | 12/2011 | Sarkisian et al. | |
| 2012/0034398 | A1 | 2/2012 | Wang et al. | |
| 2013/0076842 | A1 | 3/2013 | Sarkisian et al. | |
| 2014/0055520 | A1 | 2/2014 | Inumaru et al. | |

* cited by examiner

PRINT MEDIUM

BACKGROUND

Publishing documents using low cost media has historically been accomplished using offset presses. Offset presses provide high quality text and images very efficiently and have become an industry standard. Because of the pervasiveness, the cost of the offset media is very low. Offset presses are efficient when large quantities of a single recurring image or page are desired. However, the presses become less desirable as quantities of a single image are reduced because with offset printing presses, each run is set up separately by the operator, thus causing an increase time and expense. Stated another way, offset printing can be less effective when variability of prints is desired, making other solutions more attractive in some circumstances.

In recent years, digital presses such as inkjet web presses have been developed that are able to displace offset printing with smaller run sizes or for fully variable printing. However, for aqueous inkjet web presses, the cost per print can be relatively high due to a higher media cost. More specifically, with these digital web presses that utilize aqueous-based inkjet inks, it is not a simple matter of simply using the inkjet ink on existing offset press media, as the inks and media do not typically have compatible enough properties to provide a pleasing end result for customers. For example, water (present in relatively large quantities in aqueous inkjet inks) tends to swell offset media resulting in a problem called "cockle" in which variability in water-based swelling causes thin publishing medias to buckle, leaving the resultant images in an unacceptable wavy state that is not appealing.

BRIEF DESCRIPTION OF THE DRAWINGS

Additional features and advantages of the disclosure will be apparent from the detailed description which follows, taken in conjunction with the accompanying drawings, which together illustrate, by way of example, features of the technology; and, wherein.

Figure 1:
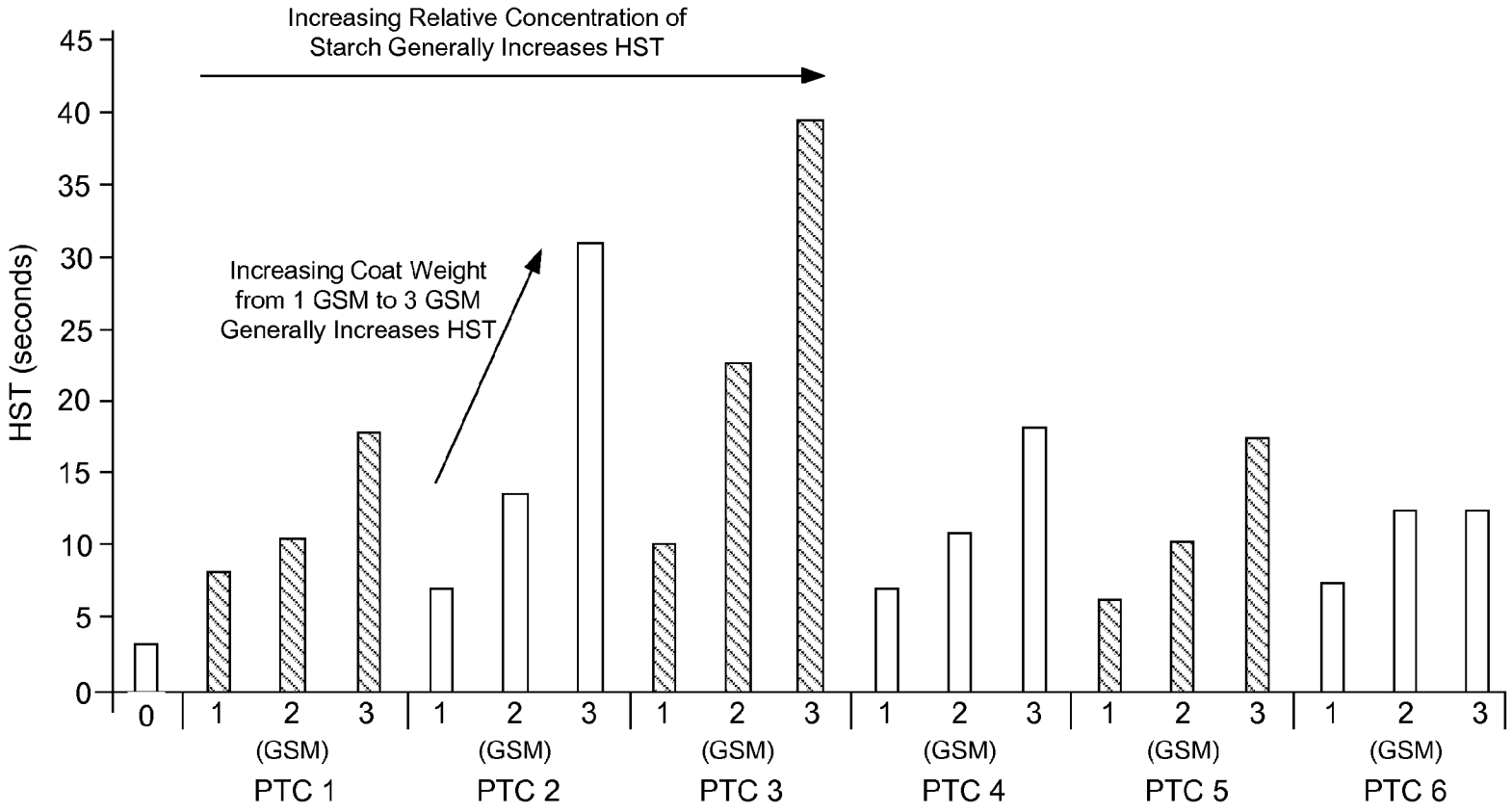
FIG. 1 provides a bar graph comparing coat weight and/or water holdout agent concentration to water hold out time in accordance with examples of the present disclosure.

Reference will now be made to several examples that are illustrated herein, and specific language will be used herein to describe the same. It will nevertheless be understood that no limitation of the scope of the disclosure is thereby intended.

DETAILED DESCRIPTION

Pre-treatment compositions or coatings can generally be applied to various types of media to improve printing characteristics and attributes of an image. Such composition can be substantially colorless and can be formulated to interact with the colorant of certain ink compositions to improve printing characteristics. For example, colorant deposited and precipitated on a surface of recording media can provide enhancements to image quality and other print characteristics, such as improved optical density or gamut, higher speed printing, or the like. However, with particularly thin media often used in publishing or offset presses, coatings that may otherwise provide acceptable image quality still may not provide some of the other characteristics that would allow them to compete with offset printing. Durability, image fixation, and appropriate flatness of the printed media are also considerations when determining if a printed image has a competitive look and functionality compared to traditional offset press printed media.

As a result, in accordance with examples of the present technology, there are applications where it may be desirable to print inkjet inks very quickly on thin paper that may otherwise be susceptible to fast water penetration. In accordance with examples of the present disclosure, a print medium can include a thin paper substrate having weight ranging from 40 GSM to 150 GSM (grams per square meter), or from 40 GSM to 100 GSM, and a pre-treatment coating applied to the thin paper substrate at a weight ranging from 0.3 GSM to 15 GSM, or from 0.5 GSM to 10 GSM. The pre-treatment coating can include from 10 wt % to 80 wt % of a fixer, from 3 wt % to 50 wt % of a latex polymer, and from 5 wt % to 50 wt % of a water holding agent.

In another example, a printed article can include a thin paper substrate having weight ranging from 40 GSM to 150 GSM, or from 40 GSM to 100 GSM, and a pre-treatment coating applied to the thin paper substrate at a weight ranging from 0.3 GSM to 15 GSM, or from 0.5 GSM top 10 GSM. The pre-treatment coating can include from 10 wt % to 80 wt % of a fixer, from 3 wt % to 50 wt % of a latex polymer, and from 5 wt % to 50 wt % of a water holding agent. The printed article can also include an aqueous inkjet ink printed on the pre-treatment coating. Thus, after drying of the aqueous inkjet ink, the printed article may exhibit no more than a 1.5 mm average height difference between unprinted areas and printed areas, or alternatively no more than 1.0 mm difference between unprinted areas and printed areas. In this example, the average height difference between the unprinted areas and printed areas when printed directly on the thin paper substrate are typically greater, e.g., 20% greater, 50% greater, or 100% greater.

In another example, a method of inkjet printing can include inkjet printing an aqueous inkjet ink onto a print medium, the print medium including a thin paper substrate having weight ranging from 40 GSM to 150 GSM, or from 40 GSM to 100 GSM, and a pre-treatment coating applied to the thin paper substrate at a weight ranging from 0.3 GSM to 15 GSM, or from 0.5 GSM to 10 GSM. The pre-treatment coating can include from 10 wt % to 80 wt % of a fixer, from 3 wt % to 50 wt % of a latex polymer, and from 5 wt % to 50 wt % of a water holding agent. Additional steps can include holding the aqueous inkjet ink in the pre-treatment coating a period of time before water from the inkjet ink contacts the thin paper substrate, and beginning to dry the inkjet ink using a heating element before the period of time expires.

It is noted that when discussing the present print media, printed articles, and methods, each of these discussions can be considered applicable to each of these embodiments, whether or not they are explicitly discussed in the context of that embodiment. Thus, for example, in discussing a fixer used in a pre-treatment coating of a print medium, such a fixer can also be used in the printed article or method, and vice versa.

Examples of papers that can be used for the thin paper substrate include thin offset media, thin uncoated or coated paper media, such as Appleton Coated Utopia Book, Appleton Coated Utopia Thinbook, Appleton Coated Utopia GW Book, NewPage Sterling Ultra Book, NewPage Publishers Matte, NewPage New Era, or the like. This type of media is referred to herein as "thin paper" or "thin paper substrate" herein, with the word "substrate used in the context where the thin paper acts as a base for application of the pre-treatment coatings of the present disclosure. Often, these types of media exist in rolls having a 40 GSM to 150 GSM (grams per square meter) weight. More specific exemplary weights may range from 40 GSM to 100 GSM, 50 GSM to 80 GSM, with two specific examples being about 60 or about 67 GSM. These papers can be uncoated, paper fibers with or without a surface sizing, or can be coated paper fibers with one or more coating layers to enhance paper and print performance.

In one example, these thin paper substrates include primarily wood pulp and, in some instances, can have a very thin initial coating applied beneath the pre-treatment coatings of the present disclosure. One example of publishing media is newsprint media which is a low-cost non-archival paper used to print newspapers, other publications, and advertisements. A second example is coated book paper which is used to print text books. Another example of at least partially glossy publishing media is offset media used for magazines and direct mailed advertising. Unlike newsprint, this media has some degree of gloss. The media gloss may be a result of calendaring the media between pinch rollers and/or a thin media coating. All of these papers perform well for their intended print method (offset printing), where very little water is applied to the paper, but perform very poorly for image quality and flatness when printed with Inkjet printers.

In further detail regarding examples of the present technology, the thin paper can be coated with primer or pre-treatment coating that includes a water holding agent for slowing water penetration into the media, a fixer such as a polyvalent salt (e.g., $CaCl_2$), a latex to assist with durability, and in some examples, wax beads to improve wet durability and dry durability. These pre-treatment coatings can be applied to the thin paper at a very thin coat weight ranging from 0.3 GSM to 15 GSM, for example.

In accordance with examples of the present disclosure, a water-based inkjet ink can be printed on the coated media of the present disclosure, and printed media can be dried within 30 seconds, within 10 seconds, or within 5 seconds of printing the ink on the media substrate. The term "dried" is defined to mean dry enough to prevent water from contact the underlying thin paper medium at a sufficient amount to generate paper cockle of no more than 1.5 mm of height difference between printed an unprinted areas, or in some examples, no more than 1 mm, no more than 0.75 mm, or no more than 0.5 mm. In one example, the printing system includes an in-printer drying system and the drying section of the system begins to dry the ink within about 5 seconds, within 3 seconds, or within 1 second after printing takes place. Compared to many prior systems that print on thin paper media with inkjets, the resultant prints prepared on the coated media of the present disclosure can be very flat or essentially cockle-free.

In certain examples, the print media, printed articles, and methods of the present technology provide the ability to use very low cost and thin publishing media in high speed inkjet printers while achieving high quality, flat, and durable prints. Thus, highly productive aqueous inkjet web presses can be used to effectively address publishing opportunities that may not have been practical in the past. This is partly because the pre-treatment coatings applied to the thin media paper provides acceptable print quality and a high degree of flatness (low cockle) at much higher levels of ink, even though there may be a much lower basis weight for the papers used. The printable media of the present disclosure can be prepared using publishing media generally utilized for offset printing, which usually has a media weight of less than 150 GSM (grams per square meter) and includes a wood fiber pulp base. Many of these papers tend to have a very poor ability to prevent water from passing there-through. Thus, in one example, the pre-treatment coatings of the present disclosure can be applied to these thin paper substrates to increase holdout time as evaluated using the Hercules Sizing Test (HST), as described in Tappi method T530 as of the date of the present disclosure, by at least 1 second, or more typically, at least 3 seconds, at least 5 seconds, at least 10 seconds, at least 20 seconds, at least 30 seconds, or even at least 40 seconds. The HST is conducted by preparing a solution of water, dye, and formic acid, applying the solution on top of the respective media samples, and using an optical sensor to detect when the solution penetrates the paper. Though this can be varied, in the present disclosure, the concentration of formic acid used to test the media described herein is 1 wt %. The dye used is napththol green B and concentration of dye is 1.25 wt %. Essentially, the longer the time it takes the solution to penetrate onto the back side, the better the water holdout. Thus, an increase in HST (ΔHST) due to the pre-treatment over the thin paper substrate of as little as 1 second can be significant, particularly in inkjet printing systems that are designed to apply heat to the printed image beginning within about 10 seconds, within about 5 seconds, or within about 3 seconds of printing the inkjet ink onto the media substrate. Preventing even some water from reaching the thin paper substrate can significantly reduce paper cockle in some examples. For example, increasing the holdout time by 1 second can be enough time, in some circumstances, to reduce the amount of water reaching the thin paper substrate by about 50% by weight. In other examples, if the ΔHST can be increased to 3 seconds, 5 seconds, 10 seconds, 20 seconds, 30 seconds, 40 seconds, etc., often, an even better result can be achieved, as the heating or drying element used to remove volatile solvent (e.g., water) from the ink will have more time to remove more fluid from the pre-treatment coating before it has an opportunity to reach the thin paper substrate. Slowing the water from entering the thin paper substrate so that it can be dried or partially removed from the ink before penetrating too far through pre-treatment coating (such as by the use of a dryer or heating element) can reduce paper cockle that is common when water is applied to these types of thin paper substrates.

Typically, the amount of cockling that occurs is a function of the media properties, e.g., basis weight, stiffness, sizing, etc., as well as how much ink is printed, drying conditions, e.g., temperature, time between printing and drying, etc. The lower the basis weight of the paper, the more susceptible it will be to cockling. The more ink that is applied (thus typically applying more water), the more susceptible the media will also be to cockling. Through the use of the pre-treatment coating of the present disclosure, water can be held off from thin paper substrate long enough to diminish the effect of cockling, even when a relatively large volume of ink is used and the print medium is relatively thin (less than 165 GSM which includes both the substrate and the coating). As a general principle, the more water holding agent applied, the more water that can be held off or slowed down in the pre-treatment coating layer, allowing for higher ink levels to be printed while maintaining relative flatness. The pre-treatment coating can assist in leveling out these differences, regardless of what type of cockling would otherwise occur for a given type of ink or media. Increasing the amount of water holding agent can be accomplished by increasing the concentration of water holding agent in the pre-treatment coating, or by increasing the thickness of the pre-treatment coating, or both. Typically, when there are higher levels of water holding agent (by concentration and/or layer thickness), it is typical that a lower basis weight paper can be used and/or longer delays can be allowed between printing to drying.

As mentioned, the pre-treatment coatings include a fixer, a latex polymer, and a water holding agent. In some examples, a wax is also present. Examples of water holding agents include polyvinyl alcohol, polyacrylate, cellulose and cellulose derivatives, modified starches and starch derivatives, or silica gels. Regarding the water holding agent, starches can be particularly useful. The water holding agents are materials that can interact with water through mechanisms such as hydrogen bonding. This interaction between the water in the ink and the water holding agent slows down the penetration of the water through to the paper fibers. The greater the degree of this interaction, the longer it takes for the water to reach the paper fibers. By minimizing the amount of water that reaches the paper fibers, the amount of cockling can be reduced, leading to flatter sheets after printing. For example, natural starches or processed starches can be used. For example a starch can be processed and pelletted for use. An example of such a starch is sold under the trade name Ecosynthetix Ecosphere. The water holding agent can be present at any concentration effective for increasing the holding time of water or other volatile solvents expected to be present in the inkjet ink to be used therewith. However, a practical range can typically be from 5 dry weight percent (wt %) to 50 wt %, from 10 wt % to 40 wt %, or from 15 wt % to 35 wt %, for example. The dry weight percentage of a coating component is based upon the weight percentage of the component after the coating has been applied and volatile constituents have been dried from the coating. This is the case for all weight percents herein unless the context specifically indicates otherwise, i.e., the presence of a volatile constituent is present.

Regarding the fixer, this component can be a polyvalent metal salt. The polyvalent metal salt can be a divalent or a higher polyvalent metallic ion and anion. In one example, the polyvalent metal salt components can be soluble in water. Examples of polyvalent metallic ions include divalent metallic ions, such as $Ca^{2+}$, $Cu^{2+}$, $Ni^{2+}$, $Mg^{2+}$, $Zn^{2+}$ and $Ba^{2+}$; and trivalent metallic ions, such as $Al^{3+}$, $Fe^{3+}$ and $Cr^{3+}$. In one example, the polyvalent metallic ion can be $Ca^{2+}$, $Mg^{2+}$ or $Zn^{2+}$. In one aspect, the polyvalent metallic ions can be $Ca^{2+}$. Examples of anions include $Cl^-$, $I^-$, $Br^-$, $NO_3^-$ or $RCOO^-$ (where R is H or any hydrocarbon chain). In one example, the polyvalent metal salt anion can be a chloride ($Cl^-$) or acetate ($CH_3COO^-$). In other examples, the polyvalent metal salt can include divalent or other polyvalent metallic ions and nitrate or carboxylate ions. The carboxylate ions can be derived from a saturated aliphatic monocarboxylic acid having 1 to 6 carbon atoms or a carbocyclic monocarboxylic acid having 7 to 11 carbon atoms. Examples of saturated aliphatic monocarboxylic acid having 1 to 6 carbon atoms may include formic acid, acetic acid, propionic acid, butyric acid, isobutyric acid, valeric acid, isovaleric acid, pivalic acid, and/or hexanoic acid.

In one example, the fixer can be a polyvalent metal salt including calcium chloride, calcium nitrate, magnesium nitrate, magnesium acetate, and/or zinc acetate. In one aspect, the polyvalent metal salt can be calcium chloride or calcium nitrate ($CaCl_2$ or $Ca(NO_3)_2$). In one additional specific aspect, the polyvalent metal salt can be calcium chloride ($CaCl_2$).

Generally, the fixer can be present in the pre-treatment coating at a concentration ranging from 10 wt % to 80 wt %, based on the solids content (after the solvent has been removed when coated). In another example, the fixer can be present in an amount ranging from 30 wt % to 80 wt %, and in one aspect, 40 wt % to 70 wt %. It is understood that these ranges are not intended to be limiting and that the amounts can be adjusted for the desired application. Having a relatively high concentration of fixer has been found to be particularly advantageous with certain media types, such as highly porous or open cell media, but this can be determined on a case by case basis.

The pre-treatment coating can also include a latex. As used herein, "latex" can be used interchangeable with "latex particle" and refer to polymeric masses that are dispersed in a fluid. In one example, the latex particle can be made of polymers and copolymers including acrylic polymers or copolymers, vinyl acetate polymers or copolymers, polyester polymers or copolymers, vinylidene chloride polymers or copolymers, butadiene polymers or copolymers, styrene-butadiene polymers or copolymers, acrylonitrile-butadiene polymers or copolymers, or the like. In another example, the latex particle can include a vinyl acetate-based polymer, an acrylic polymer, a styrene polymer, a styrene-butadiene (SBR)-based polymer, a polyester-based polymer, a vinyl chloride-based polymer, an acid-based polymer, or the like. In one aspect, the latex particle can be a polymer or a copolymer including acrylic polymers, vinyl-acrylic copolymers, or acrylic-polyurethane copolymers. In another aspect, the latex particle can be cationic acrylate latex.

Generally, the latex particles can have a weight average molecular weight (Mw) of 5,000 Mw to 1,00,000 Mw. In one example, the latex particles can range from 150,000 Mw to 500,000 Mw. In some examples, the average particle size of the latex particles can be from 10 nm to 1 μm and, as other examples, from 10 nm to 500 nm, and in yet other examples, from 50 nm to 250 nm. The particle size distribution of the latex is not particularly limited, and either latex having a broad particle size distribution or latex having a mono-dispersed particle size distribution may be used. It is also possible to use two or more kinds of polymeric fine particles, each having a mono-dispersed particle size distribution in combination, and this would be included when referring to a latex herein.

Generally, the Tg of the latex can be from about −25° C. to 150° C. In one example, the Tg of the latex can be less than 100° C. In one aspect, the Tg of the latex can range from, from −25° C. to 80° C., and in one specific aspect, can range from −25° C. to 25° C. The glass transition temperature (Tg) parameter can be measured by Differential Scanning Calorimetry (DSC). Generally, the present latex can function to assist in providing durability and smudge resistance to the inkjet ink once it is printed on the print medium.

The latex particles can be included in the pre-treatment coating at a concentration ranging from 3 wt % to 50 wt %, based on the solids content of the pre-treatment coating after any coating solvent has been removed, e.g., after the coating is dried on the thin paper substrate. In one example, the latex particles can be present in an amount ranging from 3 wt % to 50 wt %, and in one aspect, 5 wt % to 20 wt %. It is understood that these ranges are not intended to be limiting and that the amounts can be adjusted for the desired application.

The pre-treatment coating can also include a wax. The wax can be selected based on various printing factors such as compatibility, particle size, melting point, etc. Typically, waxes are available as wax emulsions. Wax emulsions are commercially available from a number of vendors, for example Keim-Additec, Lubrizol, Michelman, and BYK Chemie. Wax emulsions useful for the present compositions can include but are not limited to: Lubrizol: Liquilube™ 411, Liquilube™ 405, Liquilube™ 488, Liquilube™ 443, Liquilube™ 454; Michelman: ME80825, ME48040, ME98040M1, ME61335, ME90842, ME91240, ML160; Keim-Additec: Ultralube® E-521/20, Ultralube® E-7093, Ultralube® 7095/1, Ultralube® E-8046, Ultralube® D806, Ultralube® E-502V, Ultralube® E-842N: Byk: Aquacer® 2650, Aquacer® 507, Aquacer® 533, Aquacer® 515, Aquacer® 537, Aquaslip™ 671, Aquaslip™ 942; Arkema: Orgasol® 2001 EXD NAT1, 3501 EXD NAT 1; Elementis: Slip-ayd® SL300, Slip-ayd® SL1618, Slip-ayd® 295A, combinations thereof, and the like.

Wax suspended in water includes, but is not limited to, particles of a synthetic wax, a natural wax, a combination of a synthetic wax and a natural wax, a combination of two or more different synthetic waxes, or a combination of two or more different natural waxes, for example. In some examples, the synthetic wax includes, but is not limited to, polyethylene, polypropylene, polybutadiene, polytetrafluoroethylene, polyvinylfluoride, polyvinyldiene fluoride, polychlorotrifluoroethylene, perfluoroalkoxy polymer, perfluoropolyether, polyurethane, polyethylenechlorotrifluoroethylene, polyethylene-vinyl acetate, epoxy resin, silicone resin, polyamide resin, polyamide, or polyester resin. In some examples, the natural wax includes, but is not limited to, carnauba wax, paraffin wax, montan wax, candelilla wax, ouricury wax, sufarcane wax, retamo wax, or beeswax. In one example, the wax can be a polyethylene wax.

In one example, the wax can have a melting point ranging from 60° C. to 150° C. Generally, the wax can be present in the pre-treatment coating at a concentration ranging from 5 wt % to 30 wt %. In one example, the wax may be present in the range of 5 wt % to 20 wt %. In another example, the wax can be present ranging from 10 wt % to 20 wt %, and in one aspect, 11 wt % to 17 wt %. Again, it is notable that these weight percentages of the wax are based on a total amount present in the pre-treatment coating after removal of any evaporable solvent. Thus, they are intended to be weight percentages by solids once the pre-treatment coating is applied to the media substrate and the evaporable solvent (e.g., water) is driven off, i.e. the final wt % on the coated media substrate.

Further, the pre-treatment coating can contain surfactants. Non-limiting examples of suitable surfactants include nonionic surfactant, cationic surfactant, and combinations thereof. In one example, the surfactant can be a nonionic surfactant. In one aspect, the surfactant can be a nonionic surfactant including nonionic fluorosurfactant, nonionic acetylenic diol surfactant, nonionic ethoxylated alcohol surfactant, and combinations thereof.

Several commercially available nonionic surfactants that can be used in the formulation of the pre-treatment composition include ethoxylated alcohols such as those from the Tergitol® series (e.g., Tergitol® 15S30, Tergitol® 15S9), manufactured by Dow Chemical; surfactants from the Surfynol® series (e.g. Surfynol® 440 and Surfynol® 465), and Dynol™ series (e.g. Dynol™ 607 and Dynol™ 604) manufactured by Air Products and Chemicals, Inc.; fluorinated surfactants, such as those from the Zonyl® family (e.g., Zonyl® FSO and Zonyl® FSN surfactants), manufactured by E.I. DuPont de Nemours and Company; Alkoxylated surfactant such as Tego® Wet 510 manufactured from Evonik; fluorinated PolyFox® nonionic surfactants (e.g., PF159 nonionic surfactants), manufactured by Omnova; or combinations thereof. Suitable cationic surfactants that may be used in the pre-treatment composition include long chain amines and/or their salts, acrylated diamines, polyamines and/or their salts, quaternary ammonium salts, polyoxyethylenated long-chain amines, quaternized polyoxyethylenated long-chain amines, and/or combinations thereof.

The surfactant, if present, can be included in the pre-treatment coating at from about 0.05 wt % to about 1.5 wt %. In one example, the surfactant can be present in an amount ranging from about 0.1 wt % to about 1 wt %. In one aspect, the surfactant can be present in an amount ranging from about 0.2 wt % to about 0.6 wt %.

Other additives can be added to the pre-treatment matrix including cross-linkers, defoamers, plasticizers, fillers, stabilizers, dispersants, biocides, optical brighteners, binders, viscosity modifiers, leveling agents, UV absorbers, anti-ozonants, etc. Such additives can be present in the pre-treatment compositions in amounts from 0.01 wt % to 20 wt %. Generally, if a binder is present, a cross-linker can be present to cross-link the binder.

General coating methods include slot-die coating, rod coating such as Mayer rod coating, blade coating, gravure coating, knife-over-roll coating, cascade coating, curtain coating, and the like. Generally the pre-treatment coatings can be applied at a basis weight of 0.1 GSM to 10 GSM. In one example, the basis weight can be from 1 GSM to 6 GSM, and in one aspect, from 1 GSM to 4 GSM. Generally, during manufacture and subsequent application to the thin paper substrate, the present pre-treatment coatings initially include water and/or other volatile solvents allowing for processability, which can be removed via drying or over time.

The present pre-treatment coatings are generally used in conjunction with an inkjet ink. Such inkjet inks generally include a colorant dispersed or dissolved in an ink vehicle. As used herein, "liquid vehicle" or "ink vehicle" refers to the liquid fluid in which a colorant is placed to form an ink. Ink vehicles are well known in the art, and a wide variety of ink vehicles may be used with the systems and methods of the present disclosure. Such ink vehicles may include a mixture of a variety of different agents, including, surfactants, solvents, co-solvents, anti-kogation agents, buffers, biocides, sequestering agents, viscosity modifiers, surface-active agents, water, etc. Though not part of the liquid vehicle per se, in addition to the colorants, the liquid vehicle can carry solid additives such as polymers, latexes, UV curable materials, plasticizers, etc.

Generally the colorant discussed herein can include a pigment and/or dye. As used herein, "dye" refers to compounds or molecules that impart color to an ink vehicle. As such, dye includes molecules and compounds that absorb electromagnetic radiation or certain wavelengths thereof. For example, dyes include those that fluoresce and those that absorb certain wavelengths of visible light. Generally, dyes are water soluble. Furthermore, as used herein, "pigment" generally includes pigment colorants, magnetic particles, aluminas, silicas, and/or other ceramics, organo-metallics or other opaque particles. In one example, the colorant can be a pigment. If a pigment is used, it can be dispersed by a separate dispersing agent, or it can be self-dispersed having a small molecule, oligomer, or polymer attached to a surface thereof to provide appropriate dispersion on the inkjet ink.

Typical ink vehicle formulations can include water, and can further include co-solvents present in total at from 0.1 wt % to 40 wt %, depending on the jetting architecture, though amounts outside of this range can also be used. Further, additional non-ionic, cationic, and/or anionic surfactants can be present, ranging from 0.01 wt % to 10 wt %. In addition to the colorant, the balance of the formulation can be purified water, and the inkjet ink can optionally also include a latex.

Consistent with the formulation of this disclosure, various other additives may be employed to enhance the properties of the ink composition for specific applications. Examples of these additives are those added to inhibit the growth of harmful microorganisms. These additives may be biocides, fungicides, and other microbial agents, which are routinely used in ink formulations. Examples of suitable microbial agents include, but are not limited to, NUOSEPT® (Nudex, Inc.), UCARCIDE™ (Union carbide Corp.), VANCIDE® (R.T. Vanderbilt Co.), PROXEL® (ICI America), and combinations thereof.

Sequestering agents, such as EDTA (ethylene diamine tetra acetic acid), may be included to eliminate the deleterious effects of heavy metal impurities, and buffer solutions may be used to control the pH of the ink. From 0 wt % to 2 wt %, for example, can be used. Viscosity modifiers and buffers may also be present, as well as other additives known to those skilled in the art to modify properties of the ink as desired. Such additives can be present at from 0 wt % to 20 wt %.

It is to be understood that this disclosure is not limited to the particular process steps and materials disclosed herein because such process steps and materials may vary somewhat. It is also to be understood that the terminology used herein is used for the purpose of describing particular examples only. The terms are not intended to be limiting because the scope of the present disclosure is intended to be limited only by the appended claims and equivalents thereof.

It is be noted that, as used in this specification and the appended claims, the singular forms "a," "an," and "the" include plural referents unless the context clearly dictates otherwise.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc. Additionally, a numerical range with a lower end of "0" can include a sub-range using "0.1" as the lower end point.

EXAMPLES

The following examples illustrate the pre-treatment compositions and methods that are presently known. However, it is to be understood that the following are only exemplary or illustrative of the application of the principles of the present compositions and methods. Numerous modifications and alternative pre-treatment compositions and methods may be devised by those skilled in the art without departing from the spirit and scope of the present compositions and methods. The appended claims are intended to cover such modifications and arrangements. Thus, while the present pre-treatment compositions and methods have been described above with particularity, the following examples provide further detail in connection with what are presently deemed to be acceptable embodiments.

Example 1

Pre-treatment Coatings

Six specific pre-treatment coating formations were prepared in accordance with Table 1, as follows:

TABLE 1

| Chemical | Type | C1 | C2 | C3 | C4 | C5 | C6 |
|---|---|---|---|---|---|---|---|
| Tegowet ® 510 | Surfactant | 0.5 | 0.5 | 0.5 | 0.5 | 0.5 | 0.5 |
| $CaCl_2$ | Fixer | 70 | 30 | 20 | 70 | 70 | 70 |
| Neocar ® 2300 | Latex | 25 | 25 | 25 | 25 | 25 | 25 |
| Ultralube ® D806 | Wax | 35 | 35 | 35 | 35 | 35 | 35 |
| Deairex ® 3040 | Defoamer | 0.5 | 0.5 | 0.5 | 0.5 | 0.5 | 0.5 |
| Penford ® Gum 280 | Starch (Water Holding Agent | — | — | — | — | — | 40 |
| Ecosynthetix Ecosphere ® 2202 | Starch (Water Holding Agent | 40 | 40 | 40 | 20 | 10 | — |
| Total Parts by Weight | | 171 | 131 | 121 | 151 | 141 | 171 |

*The total parts are by weight based on solids content after coating on a media substrate and evaporable solvent(s) has been removed.
**Coat weights applied to media: 1 GSM, 2 GSM, and 3 GSM.
***Each pre-treatment coating composition can be prepared using enough water (or other evaporable solvent or solvent system) suitable to provide a coating viscosity for application using a blade or other coating device.

Example 2

Pre-treatment Coatings for Increasing Water Holdout Time

The six pre-treatment coatings of Table 1 (C1-C6) were applied to a thin media substrate (40 Pound Appleton Coated Utopia Book Text Paper; 60 GSM) that is otherwise highly susceptible to water permeation. Each pre-treatment coating (C1-C6) was coated on various samples of the media substrate at three different thicknesses (1 GSM, 2GSM, and 3 GSM). A sizing test was conducted on each coated sample, as well as on a sample of the thin media substrate without pre-treatment coating applied thereto. The sizing test used is known in the art as "the Hercules Sizing Test" or "HST." HST is conducted by preparing a solution of water, dye, and formic acid; applying the solution on top of the respective media samples; and using an optical sensor to detect when the solution penetrates the paper. The concentration of formic acid used in this example was 1 wt %. The dye used was naphthol green B, and the concentration of dye used in this example was 1.25 wt %. Essentially, the longer the time it takes the solution to penetrate onto the back side of the media, the better the water holdout performance. The results of this test are provided in FIG. 1 which is a bar chart that plots HST values versus the application of various pre-treatment coatings at varying coating weights, as well as one sample where no pre-treatment coating was applied to the thin paper substrate. The vertical axis is the HST value in seconds and the horizontal axis corresponds to the six pre-treatment coatings listed in Table 1 (C1 to C6) coated at three different coating weights (1 GSM, 2 GSM, and 3 GSM). The first bar depicts the data for the uncoated thin paper substrate as baseline, i.e. less than 5 seconds. The next three bars labeled PTC 1 (or pre-treatment coating 1) in FIG. 1 correspond to the use of the C1 pre-treatment coating taken from Table 1 with coating weights of 1, 2, and 3 GSM. As can be seen, the addition of the pre-treatment coating increased the HST value substantially. The remaining bars depict HST values for the remaining pre-treatment coatings of Table 1 applied at various thicknesses.

Essentially, it became apparent by this example that the water holding agent, which in these examples was a starch, in the pre-treatment coating interacted with the water and slowed its penetration into and through the paper. Any increased value in holdout time using the Hercules Sizing Test (ΔHST measured in seconds) compared to the holdout time of untreated paper indicated that water holding agent is slowing the penetration into the paper. Increasing the amount of the water holding agent, either through higher coat weight applied, or higher concentration in the pre-treatment coating, or a combination of these two methods when applied to the paper can increase the ΔHST, slowing water penetration. In these examples, the increase of holdout time compared to the thin paper substrate without a pre-treatment coating was shown to be as high as a ΔHST of about 35 seconds in one example. On the low end, a ΔHST of about 3 seconds (which represents 3 seconds before the water reaches the base substrate) was achieved.

It is noted that slowing the water penetration through a pre-treatment coating can be favorable to merely slowing water penetration through the paper fibers per se, although both can lead to increased water holdout time. The slower penetration of the formic acid solutions (as well as aqueous inkjet inks) through the pre-treatment coating can lead to less water reaching the paper fibers in the first place, providing benefits including reducing paper cockle induced by wetting of the fibers.

Example 3

Pre-treatment Coating Impact on Paper Cockle

Figure 2:
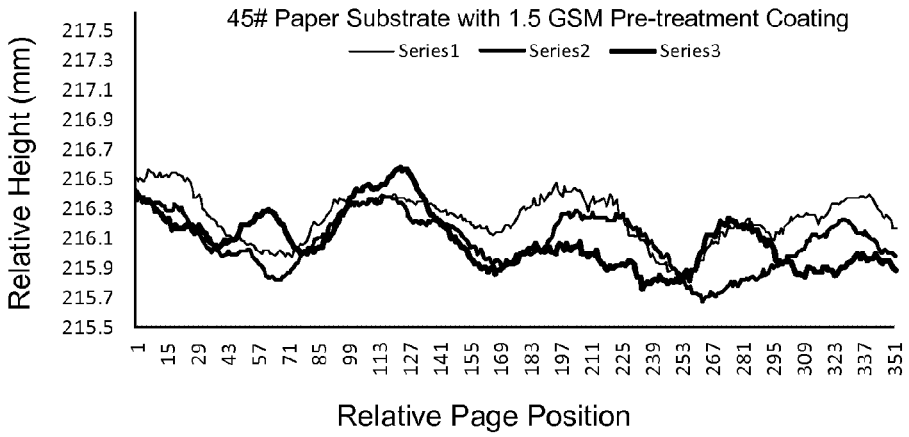
FIG. 2 provides three graphs comparing paper cockle of a commercially available inkjet media against two print media samples prepared in accordance with examples of the present disclosure.
Figure 2:
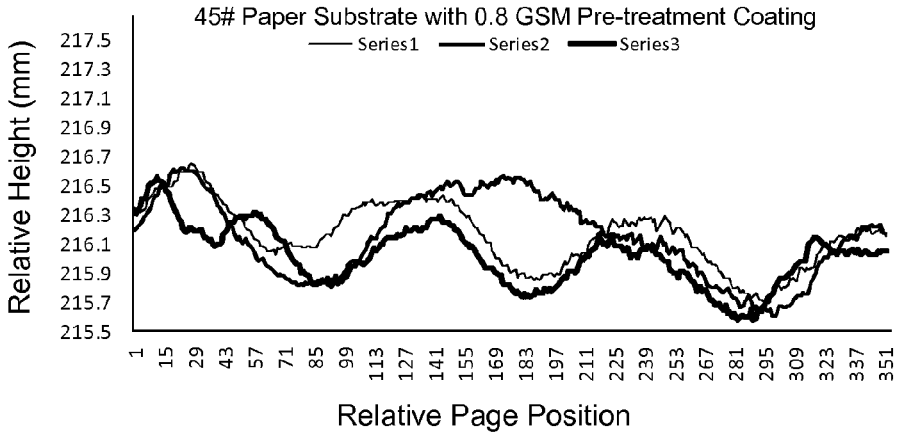
Figure 2:
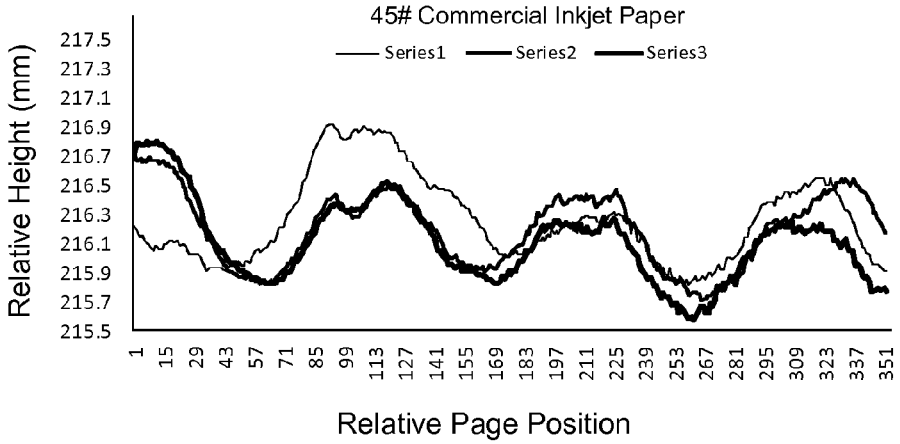

A thin paper substrate (45 pound Appleton Coated Utopia 3) was coated with a coating composition of Example 1 (specifically pre-treating coating C1 was used) at two different coat weights (1.5 GSM and 0.8 GSM). For comparison purposes, a media substrate from the same company, but which is specifically designed for inkjet ink printing was also obtained for testing (45 pound Appleton Coated InkJet), as a commercially available inkjet paper would be expected to perform acceptably with inkjet inks. Specifically, to each of the three samples, a checkerboard pattern was printed using an HP Inkjet Web Press using a commercially available ink available from Hewlett Packard Company having Part No. HP A50, and a change in Relative Height in millimeters (Vertical Axis) induced by the inkjet ink comparing the printed portions and unprinted portions was measured at multiple locations indicated by Relatively Page Positions (Horizontal Axis) using a laser profilometer (laser-based measuring instrument used to measure the geometric profile of a surface). The inkjet media (not coated by the C1 coating) clearly showed more cockling of the paper induced by printing of the checkerboard pattern. The pre-treatment coated samples, on the other hand, showed a decreased change in height as well as less pronounced waves from the checkerboard pattern due to decreased cockling. Even the lower coat weight (0.8 GSM) of pre-treatment coating showed improvement over the commercially available inkjet media, and the higher coat weight (1.5 GSM) showed a much greater improvement in paper cockle. The data for this study is shown in FIG. 2. In FIG. 2, the various "Series" indicate three different runs conducted to verify the repeatability of the data. Low points on the graph indicated locations where the height was low, and high points on the graph indicated where the height of the cockle at that location was high. An average difference between three high points and three low points revealed an average height difference. The commercially available inkjet media had a height difference of 1.11 mm, the 0.8 GSM coated media had a height difference of 0.97, and the 1.5 GSM coating had a height difference of 0.77 mm, indicating a significant improvement.

Example 4

Alternative Water Holding Agent

Two formulations were prepared that included polyvinyl alcohol (Weight Average Molecular Weight: 205,000 Mw and 27,000 Mw) samples at 20 parts by weight admixed with precipitated calcium carbonate at 100 parts by weight for the purpose of testing water holdout of these two polyvinyl alcohol samples. These pre-treatment coatings were applied to a thin paper substrate (40 Pound Appleton Coated Utopia Book Text Paper; 60 GSM) at coat weights of 1 GSM, 2 GSM, 4 GSM, and 6 GSM. The paper without a pre-treatment coating had an HST value of 6.7. The average ΔHST value for the 205K PVA was as follows: A 1 GSM applied pre-treatment coating weight resulted in a ΔHST value of 6.8; A 2 GSM applied coating weight resulted in a ΔHST value of 15.8; A 4 GSM applied coating weight resulted in a ΔHST value of 34.1; and A 6 GSM applied coating weight resulted in a ΔHST value of 48.4. The average ΔHST value for the 27K Mw PVA was as follows: A 1 GSM applied coating weight resulted in a ΔHST value of 9.12; A 2 GSM applied coating weight resulted in a ΔHST value of 20.8; A 4 GSM applied coating weight resulted in a ΔHST value of 31.9; and A 6 GSM applied coating weight resulted in a ΔHST value of 40.4. As can be seen from these values, the water holdout time for PVA is comparable in effectiveness to the starches tested in Example 2.

While the present technology has been described with reference to certain examples, those skilled in the art will appreciate that various modifications, changes, omissions, and substitutions can be made without departing from the spirit of the disclosure. It is intended, therefore, that the disclosure be limited only by the scope of the following claims.

What is claimed is:

1. A print medium, comprising:

a thin paper substrate having a basis weight ranging from 40 GSM to 100 GSM; and a pre-treatment coating applied to the thin paper substrate at from 0.3 GSM to 15 GSM, the pre-treatment coating, comprising:

from 10 wt % to 80 wt % of a fixer;

from 3 wt % to 50 wt % of a latex polymer; and from 5 wt % to 50 wt % of a water holding agent.

2. The print medium of claim 1, wherein the water holding agent is a polyvinyl alcohol, a polyacrylate, a cellulose, a starch, a silica gel, a derivative thereof, or a combination thereof.

3. The print medium of claim 1, wherein the water holding agent is a starch or polyvinyl alcohol.

4. The print medium of claim 1, wherein the fixer is a polyvalent salt.

5. The print medium of claim 1, wherein the latex polymer is selected from the group of polyacrylates, polyvinyls, polyurethanes, ethylene vinyl acetates, styrene acrylic copolymers, styrene butadienes, polymethacrylates, polyacrylic acids, polymethacrylic acids, and combinations thereof.

6. The print medium of claim 1, further comprising a wax.

7. The print medium of claim 1, wherein the thin paper substrate is an uncoated or coated, wood fiber, pulp base paper.

8. The print medium of claim 1, having an increase in measured value for a Hercules Sizing Test, or ΔHST, 2 seconds comparing the thin paper substrate to the print medium after coating.

9. The print medium of claim 1, wherein the thin paper substrate has a basis weight ranging from 50 GSM to 80 GSM.

10. A printed article, comprising:

a thin paper substrate having a basis weight from 40 GSM to 100 GSM;

a pre-treatment coating applied to the thin paper substrate at from 0.3 GSM to 15 GSM, the pre-treatment coating comprising from 10 wt % to 80 wt % of a fixer, from 3 wt % to 50 wt % of a latex polymer, and from 5 wt % to 50 wt % of a water holding agent; and an aqueous inkjet ink printed on the pre-treatment coating, wherein after drying of the aqueous inkjet ink, the printed article exhibits no more than a 1.5 mm height difference between unprinted areas and printed areas.

11. The printed article of claim 10, wherein the printed article exhibits no more than a 1.0 mm height difference between unprinted areas and printed areas.

12. A method of inkjet printing, comprising:

inkjet printing an aqueous inkjet ink onto a print medium, the print medium comprising a thin paper substrate having a basis weight from 40 GSM to 100 GSM and a pre-treatment coating applied to the thin paper substrate at from 0.3 GSM to 15 GSM, the pre-treatment coating comprising from 10 wt % to 80 wt % of a fixer, from 3 wt % to 50 wt % of a latex polymer, and from 35 wt % to 50 wt % of a water holding agent;

holding the aqueous inkjet ink in the pre-treatment coating a period of time before an evaporable solvent from the inkjet ink contacts the thin paper substrate; and beginning to dry the inkjet ink using a heating element before the period of time expires.

13. The method of claim 12, wherein the pre-treatment coating further comprises a wax.

14. The method of claim 12, where the step of beginning to dry the inkjet ink occurs within 3 seconds.

15. The method of claim 12, wherein the step of holding the aqueous inkjet ink is at least 2 seconds.

16. The print medium of claim 1, wherein the latex polymer includes a vinyl acetate-based polymer.

17. The print medium of claim 1, wherein the latex polymer includes an ethylene vinyl acetate.

18. The print medium of claim 1, wherein pre-treatment coating comprises from 30 wt % to 80 wt % of the fixer.

19. The print medium of claim 1, having an increase in measured value for a Hercules Sizing Test, or ΔHST, of 3 seconds comparing the thin paper substrate to the print medium after coating.

* * * * *